US009752576B2

(12) United States Patent
Ma et al.

(10) Patent No.: US 9,752,576 B2
(45) Date of Patent: Sep. 5, 2017

(54) VARIABLE FLOW ENGINE OIL PUMP

(71) Applicant: ZUISHO PRECISION INDUSTRIAL CO., LTD., Tainan (TW)

(72) Inventors: Huei-Shen Ma, Tainan (TW); Ying-Yi Ho, Kaohsiung (TW)

(73) Assignee: ZUISHO PRECISION INDUSTRIAL CO., LTD., Tainan (TW)

( * ) Notice: Subject to any disclaimer, the term of this patent is extended or adjusted under 35 U.S.C. 154(b) by 296 days.

(21) Appl. No.: 14/547,105

(22) Filed: Nov. 18, 2014

(65) Prior Publication Data

US 2016/0138591 A1 May 19, 2016

(51) Int. Cl.
*F04B 49/08* (2006.01)
*F04C 14/22* (2006.01)
*F04C 2/10* (2006.01)

(52) U.S. Cl.
CPC ..... *F04C 14/22* (2013.01); *F04C 2/102* (2013.01); *F04C 2210/206* (2013.01)

(58) Field of Classification Search
CPC ..... F04C 2/123; F04C 2/084; F04C 14/10; F04C 14/12; F04C 14/14
USPC ..... 418/19
See application file for complete search history.

(56) References Cited

U.S. PATENT DOCUMENTS 2,685,842 A * 8/1954 Hufferd ..... F04C 14/10 418/26
4,413,960 A * 11/1983 Specht ..... F04C 14/22 418/171
2008/0019846 A1* 1/2008 White ..... F04C 2/102 417/310

* cited by examiner

*Primary Examiner* — Mark Laurenzi
*Assistant Examiner* — Anthony Ayala Delgado
(74) *Attorney, Agent, or Firm* — Pai Patent & Trademark Law Firm; Chao-Chang David Pai

(57) ABSTRACT

A variable flow engine oil pump has a first seat, a second seat attached to the first seat, and a regulating valve assembly and a pressurizing assembly mounted in the second seat. An eccentric wheel of the pressurizing assembly meshes with a plug of the regulating valve assembly. With the plug driving the eccentric wheel to rotate by an angle, a volume flow rate of engine oil output by the engine oil pump can be adjusted. Elements used for adjusting the output of the engine oil are reduced, and manufacturing cost and assembling complexity of the engine oil pump are lowered accordingly. Moreover, since the regulating valve assembly drives the pressurizing assembly directly, the regulating valve assembly can drive the pressurizing assembly efficiently.

9 Claims, 7 Drawing Sheets

VARIABLE FLOW ENGINE OIL PUMP

BACKGROUND OF THE INVENTION

1. Field of the Invention

The present invention relates to an engine oil pump, especially an engine oil pump that has simplified transmission mechanism for adjusting an output volume flow rate of engine oil.

2. Description of the Prior Art(s)

An engine oil pump is used for pressurizing and circulating engine oil. The engine oil pump provides the engine oil to a cylinder of an internal combustion engine for the purpose of lubrication, so as to allow pistons to slide smoothly.

With reference to FIG. 7, a conventional engine oil pump comprises a main seat 61, a regulating valve 62, an inner rotor 63, an outer rotor 64, and an eccentric wheel 65. The main seat 61 has a first oil chamber 611, a second oil chamber 612, a pressurizing chamber 613, an oil return channel 614, and an oil regulating chamber 615. The pressurizing chamber 613 is formed between the first oil chamber 611 and the second oil chamber 612. The oil regulating chamber 615 communicates between the second oil chamber 612 and the oil return channel 614. The regulating valve 62 is mounted in the oil regulating chamber 615. The inner rotor 63 and the outer rotor 64 engage with each other and are mounted in the pressurizing chamber 613. The eccentric wheel 65 surrounds the outer rotor 64 and is connected to the regulating valve 62 via a transmission assembly 66.

When output oil pressure of the conventional oil engine pump is raised, the engine oil with raised output oil pressure pushes the regulating valve 62 to slide. Then the regulating valve 62 drives the eccentric wheel 65 to rotate by an angle via the transmission assembly 66. Thus, quantity of the engine oil that is pressurized by the inner rotor 63 and the outer rotor 64 and is delivered to the second oil chamber 612 is reduced. Moreover, some of the engine oil in the second oil chamber 612 of the main seat 61 flows into the oil regulating chamber 615, so the output oil pressure can be lowered. The engine oil in the oil regulating chamber 615 may further flow back to the first oil chamber 611 via the oil return channel 614 to lower down the output oil pressure automatically. Therefore, the conventional engine oil pump that has the transmission assembly 66, the eccentric wheel 65, and the gear type inner and outer rotors 63, 64 mounted in the main seat 61, and the regulating valve 62 mounted in the oil regulating chamber 615 of the main seat 61 can well control flowing of the engine oil.

In the conventional engine oil pump, the transmission assembly 66 includes multiple gears engaging with each other, so as to drive the eccentric wheel 65 to rotate and to regulate and to circulate the engine oil. However, the conventional engine oil pump with the multiple gears needs too many components for driving related mechanisms. Therefore, the conventional engine oil pump has high manufacturing cost and high assembling complexity. Furthermore, since the gears transmit movements indirectly, the transmission assembly 66 of the conventional engine oil pump is inefficient.

To overcome the shortcomings, the present invention provides a variable flow engine oil pump to mitigate or obviate the aforementioned problems.

SUMMARY OF THE INVENTION

The main objective of the present invention is to provide a variable flow engine oil pump. The variable flow engine oil pump has a first seat, a second seat attached to the first seat, and a regulating valve assembly and a pressurizing assembly mounted in the second seat. An eccentric wheel of the pressurizing assembly meshes with a plug of the regulating valve assembly.

With the plug driving the eccentric wheel to rotate by an angle, a volume flow rate of engine oil output by the engine oil pump can be adjusted. Elements used for adjusting the output volume flow rate of the engine oil are reduced, and manufacturing cost and assembling complexity of the engine oil pump are lowered accordingly. Moreover, since the regulating valve assembly drives the pressurizing assembly directly, the regulating valve assembly can drive the pressurizing assembly efficiently.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
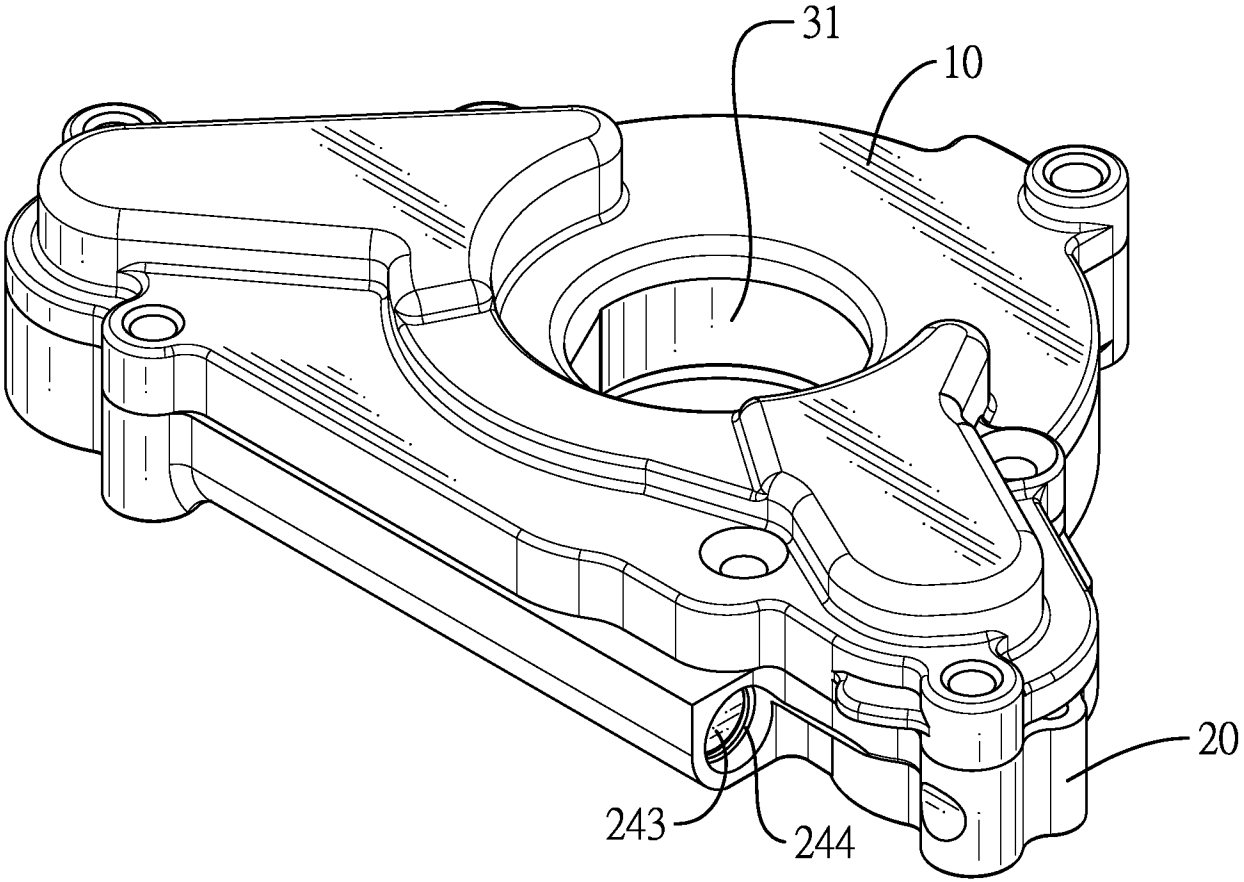
FIG. 1 is a perspective view of a variable flow engine oil pump in accordance with the present invention.
Figure 2:
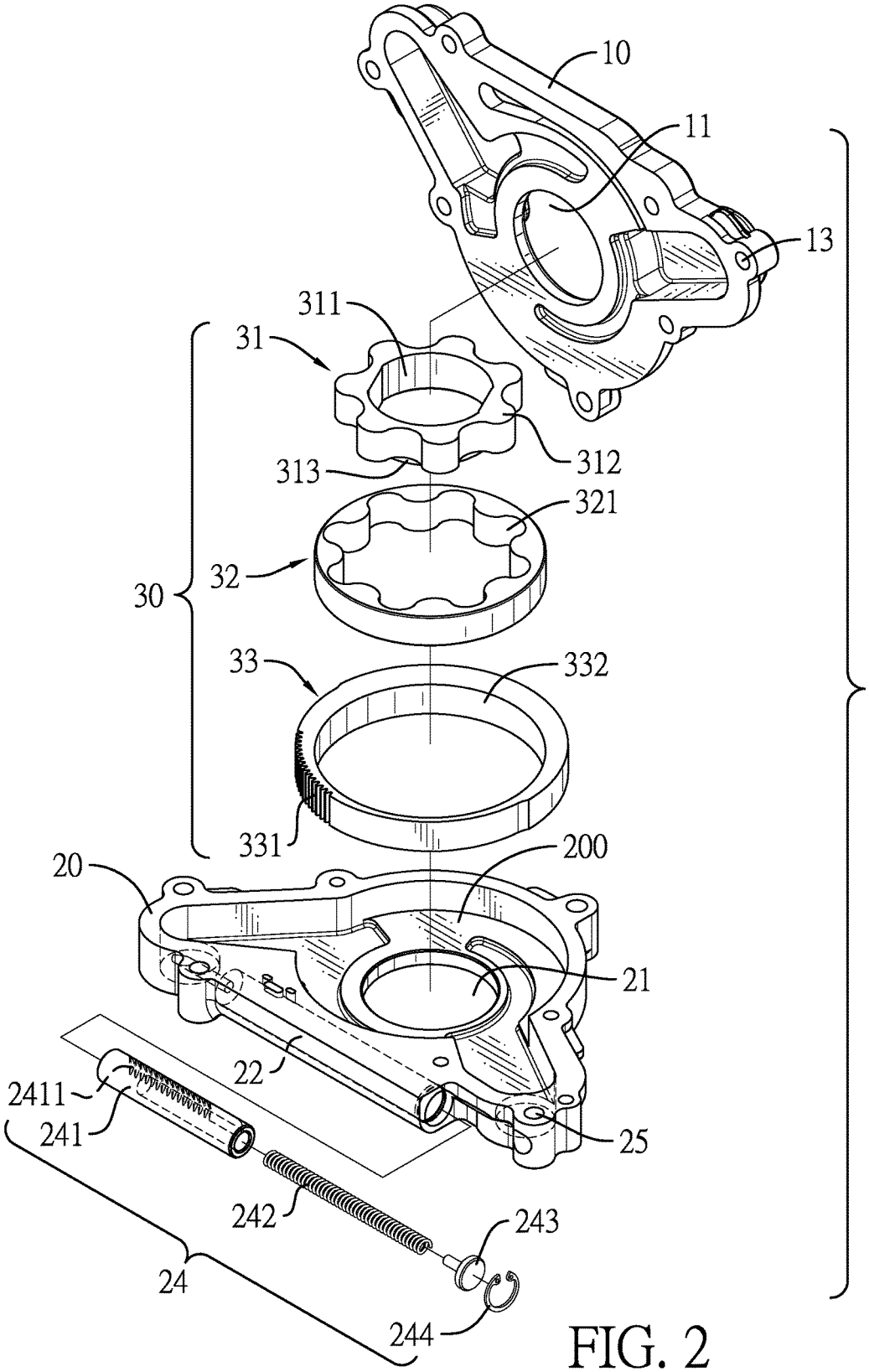
FIG. 2 is an exploded perspective view of the variable flow engine oil pump in FIG. 1.

With reference to FIGS. 1 and 2, a variable flow engine oil pump in accordance with the present invention comprises a first seat 10, a second seat 20, a regulating valve assembly 24, and a pressurizing assembly 30.

Figure 3:
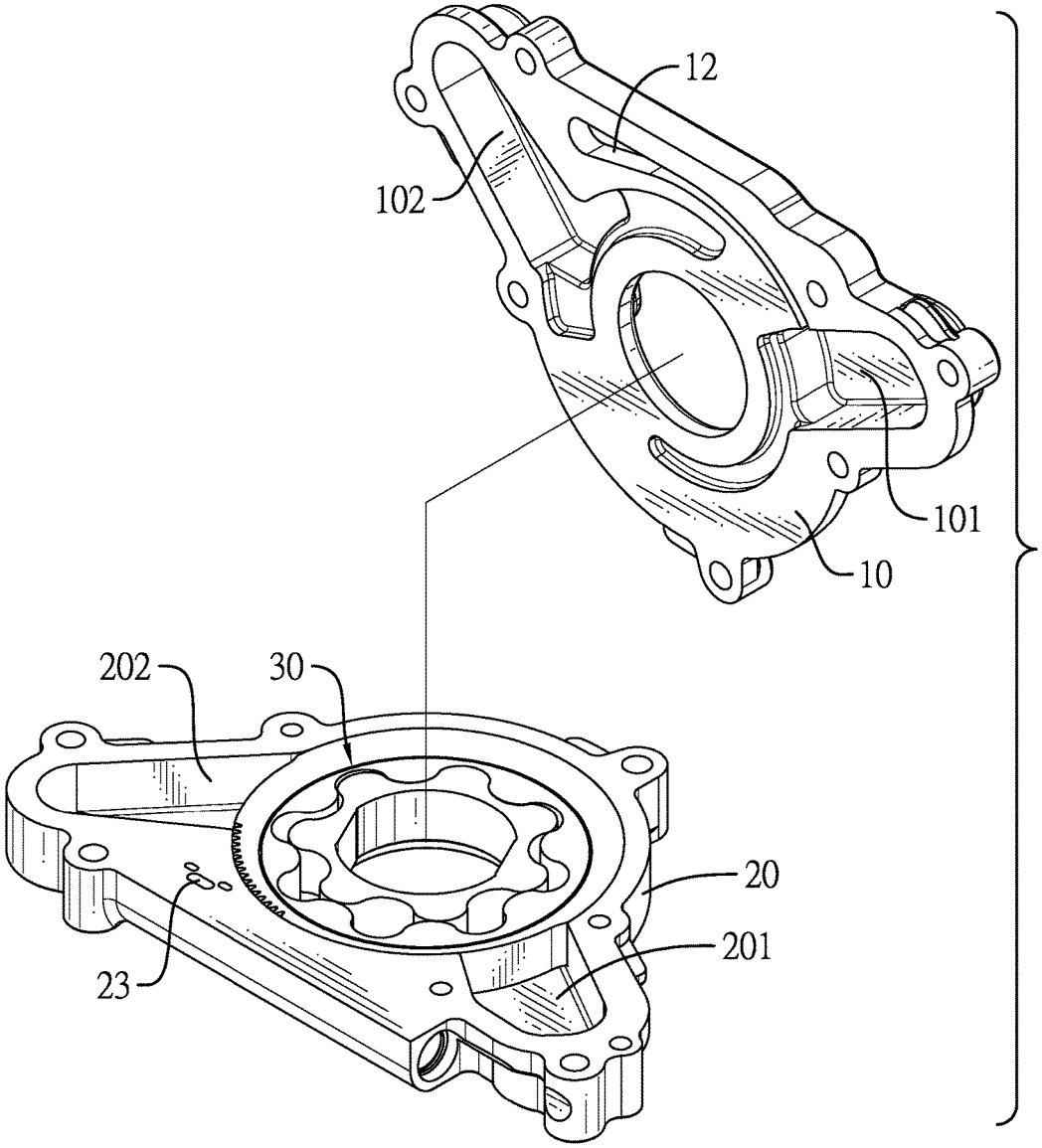
FIG. 3 is another exploded perspective view of the variable flow engine oil pump in FIG. 1.

With reference to FIGS. 2 and 3, the first seat 10 has an inner surface, two opposite ends, an outer sidewall, a first axial hole 11, a first recess 101, a second recess 102, an oil return channel 12, and multiple first fastening holes 13. The first axial hole 11 is formed through the first seat 10. The first recess 101 and the second recess 102 are formed in the inner surface of the first seat 10 and are respectively disposed adjacent to the two ends of the first seat 10. The oil return channel 12 is formed in the inner surface of the first seat 10 and communicates with the first recess 101. The first fastening holes 13 are separately formed through the first seat 10 and are arranged along the outer sidewall of the first seat 10.

Figure 4:
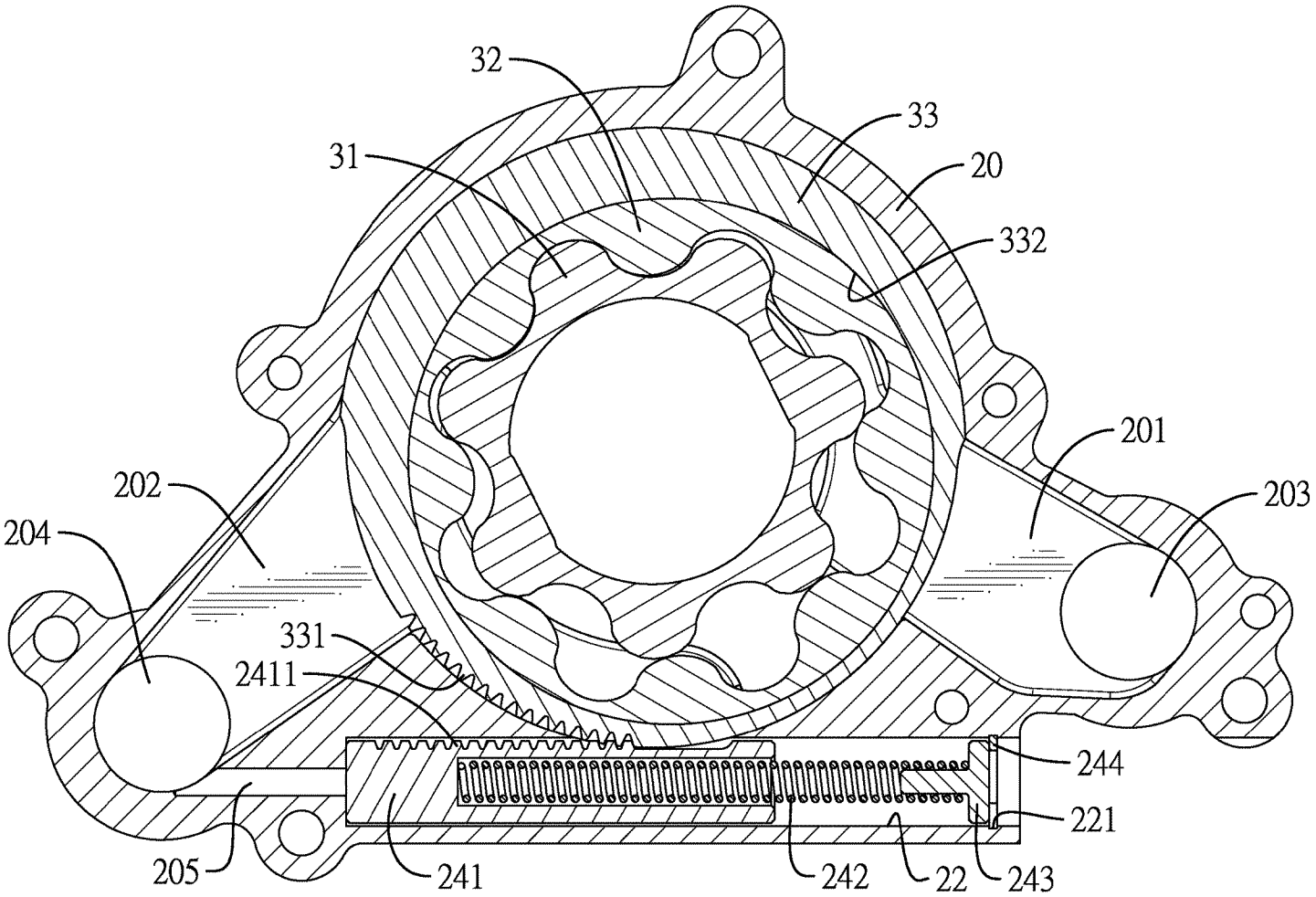
FIG. 4 is a cross-sectional top view of the variable flow engine oil pump in FIG. 1.

With reference to FIGS. 2 to 4, the second seat 20 is attached to the first seat 10 and has an inner surface, two opposite ends, an outer sidewall, a mounting recess 200, a second axial hole 21, a third recess 201, a fourth recess 202, an oil inlet 203, an oil outlet 204, an oil regulating chamber 22, a positioning groove 221, a guiding channel 205, an oil return hole 23, and multiple second fastening holes 25.

The inner surface of the second seat 20 faces and is attached to the inner surface of the first seat 10. The mounting recess 200 is formed in the inner surface of the second seat 20. The second axial hole 21 is formed through the second seat 20, corresponds in position to the mounting recess 200, and aligns with the first axial hole 11 of the first seat 10. Specifically, the second axial hole 21 is formed through an inner bottom defined in the mounting recess 200.

The third recess 201 is formed in the inner surface of the second seat 20, is disposed adjacent to one of the ends of the second seat 20, and communicates with the mounting recess 200. The third recess 201 corresponds in position to and communicates with the first recess 101 of the first seat 10. The third recess 201 and the first recess 101 form an oil inlet chamber 40. Since the oil return channel 12 communicates with the first recess 101, the oil return channel 12 communicates with the oil inlet chamber 40 as well. The fourth recess 202 is formed in the inner surface of the second seat 20, is disposed adjacent to the other end of the second seat 20, and communicates with the mounting recess 200. The fourth recess 202 corresponds in position to and communicates with the second recess 102 of the first seat 10. The fourth recess 202 and the second recess 102 form an oil outlet chamber 50.

The oil inlet 203 is formed through the second seat 20. Specifically, the oil inlet 203 is formed through an inner bottom defined in the third recess 201 of the second seat 20. The oil outlet 204 is formed through the second seat 20. Specifically, the oil outlet 204 is formed through an inner bottom defined in the fourth recess 202 of the second seat 20.

The oil regulating chamber 22 is formed in the second seat 20, is elongated, and communicates with the mounting recess 200. The oil regulating chamber 22 has an inner end and an outer end. The outer end of the oil regulating chamber 22 communicates with an exterior of the second seat 20. The positioning groove 221 is formed in an interior surface defined around the oil regulating chamber 22 and is disposed adjacent to the outer end of the oil regulating chamber 22. The guiding channel 205 is formed in the second seat 20, communicates between the inner end of the oil regulating chamber 22 and the fourth recess 202, and between the oil regulating chamber 22 and the oil outlet chamber 50.

Figure 6:
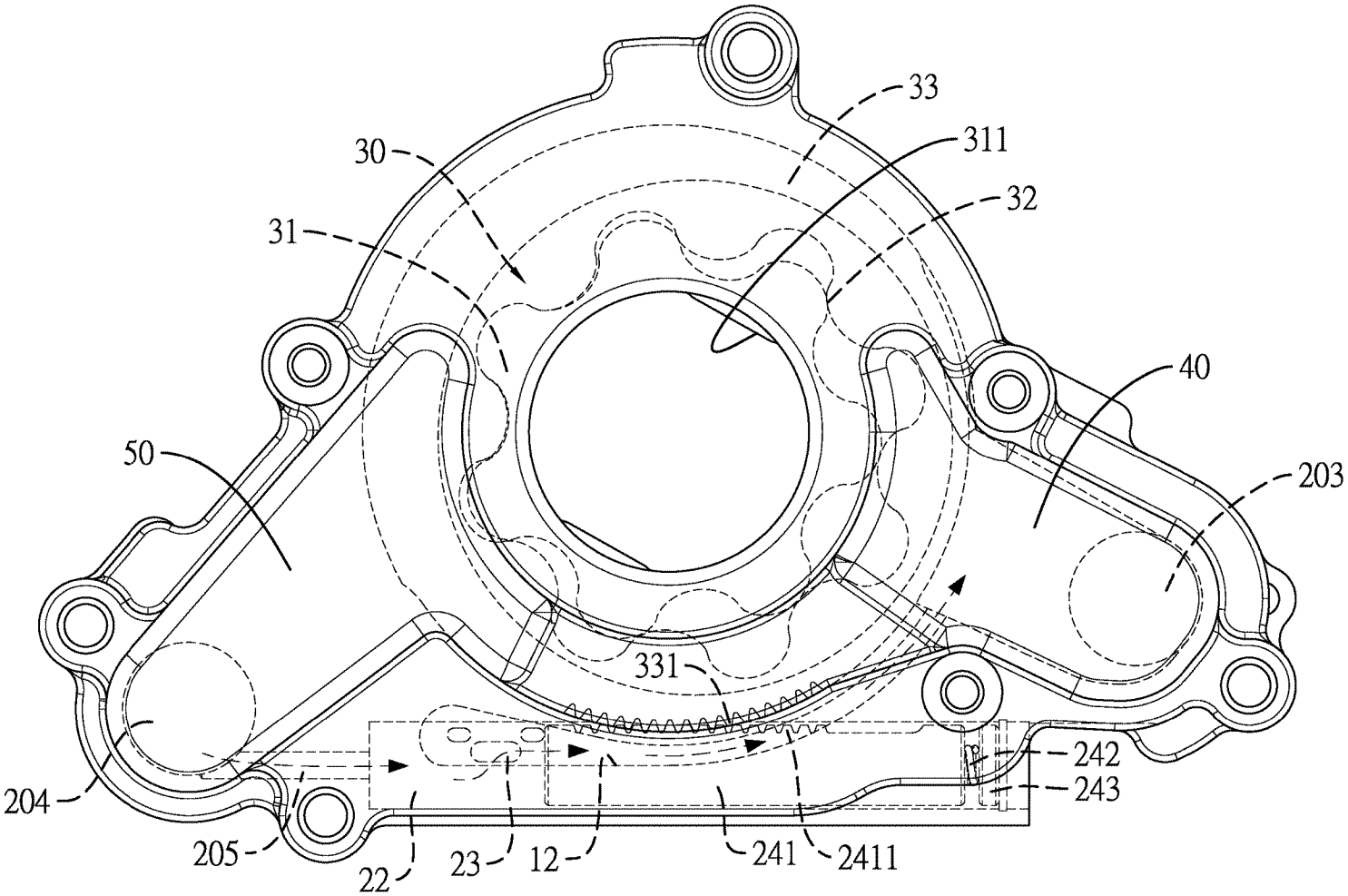
FIG. 6 is an operational top view of the variable flow engine oil pump in FIG. 1.
Figure 7:
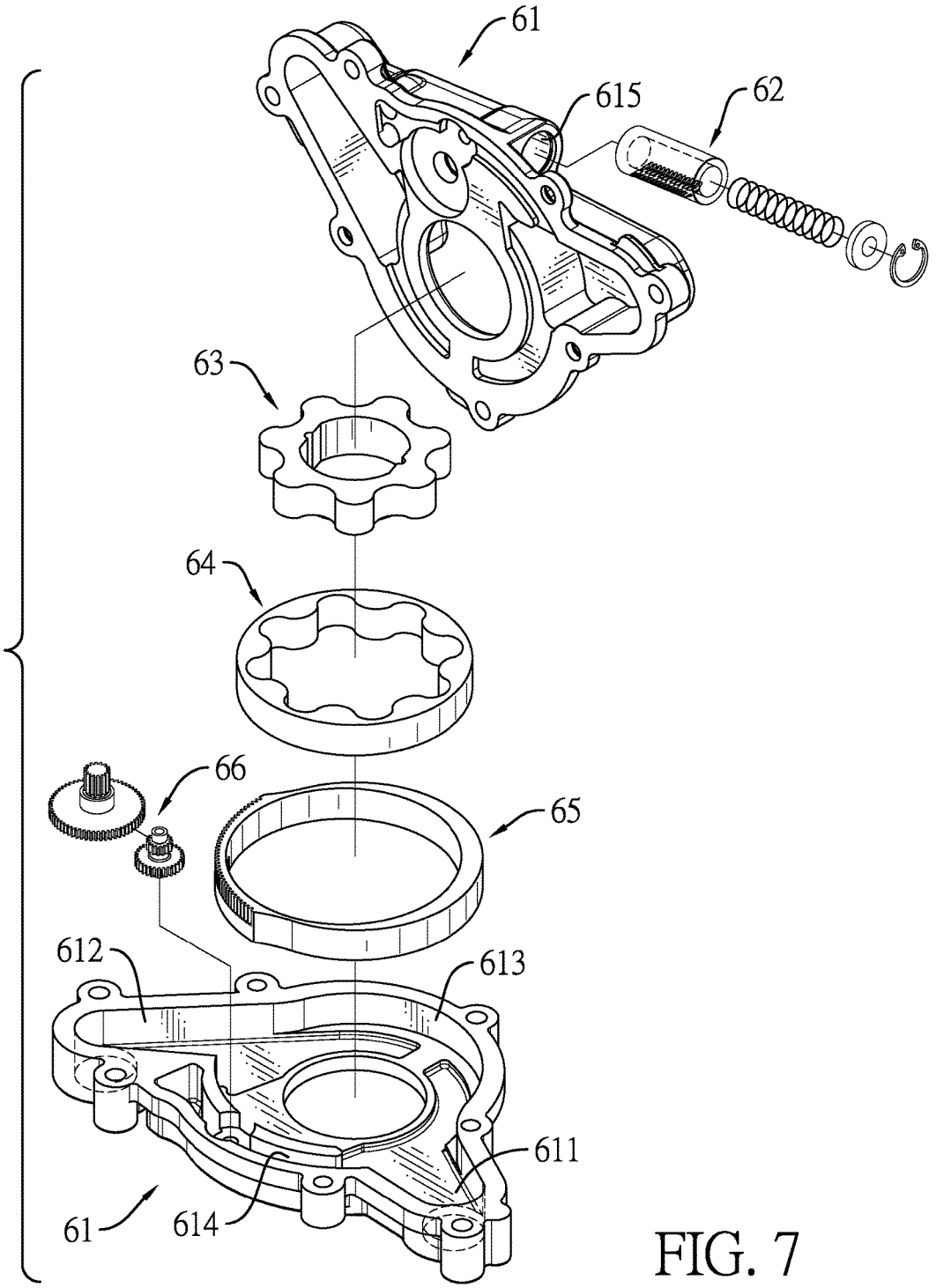
FIG. 7 PRIOR ART
FIG. 7 is an exploded perspective view of a conventional engine oil pump in accordance with the prior art.

With reference to FIG. 6, the oil return hole 23 is formed in the inner surface of the second seat 20, communicates with the oil regulating chamber 22, and corresponds in position to and communicates with the oil return channel 12 of the first seat 10.

The second fastening holes 25 are separately formed through the second seat 20, are arranged along the outer sidewall of the second seat 20, and respectively align with the first fastening holes 13 of the first seat 10. Multiple fasteners are mounted through the first fastening holes 13 and the second fastening holes 25, such that the first seat 10 and the second seat 20 are securely held together. The fasteners may be screws or bolts incorporated with nuts.

With reference to FIGS. 2 and 4, the regulating valve assembly 24 is mounted in the oil regulating chamber 22 of the second seat 20, and includes a plug 241, an end cap 243, a resilient element 242, and a retaining ring 244.

The plug 241 is cylindrical, is slidably mounted in the oil regulating chamber 22 of the second seat 20, and selectively seals the oil return hole 23. The plug 241 has an outer surface, an open end, a closed end, a receiving recess, and a driving toothed portion 2411. The closed end of the plug 241 corresponds in position to the inner end of the oil regulating chamber 22, and faces and selectively seals the guiding channel 205. The receiving recess of the plug 241 is formed in the open end of the plug 241. The driving toothed portion 2411 is formed on the outer surface of the plug 241, is disposed adjacent to the closed end of the plug 241, and is exposed to the mounting recess 200 of the second seat 20.

The end cap 243 is mounted in the oil regulating chamber 22 of the second seat 20 and is disposed adjacent to the outer end of the oil regulating chamber 22. The end cap 243 has an outer end surface, an inner end surface, and a mounting protrusion. The mounting protrusion of the end cap 243 is formed on and protrudes from the inner end surface of the end cap 243.

The resilient element 242 protrudes in the receiving recess of the plug 241 and has two opposite ends. The ends of the resilient element 242 respectively abut the plug 241 and the second seat 20. One of the ends of the resilient element 242 is mounted in the receiving recess of the plug 241 and abuts the plug 241. The other end of the resilient element 242 is mounted around the mounting protrusion of the end cap 243 and abuts the inner end surface of the end cap 243. In the preferred embodiment, the resilient element 242 is a compression spring.

The retaining ring 244 engages in the positioning groove 221 that is disposed in the oil regulating chamber 22 and abuts the outer end surface of the end cap 243. Thus, the end cap 243, the resilient element 242, and the plug 241 are constrained in the oil regulating chamber 22 of the second seat 20. In the preferred embodiment, the retaining ring 244 is a C-clip.

With reference to FIGS. 2 to 4, the pressurizing assembly 30 is mounted in the mounting recess 200 of the second seat 20 and includes an inner rotor 31, an outer rotor 32, and an eccentric wheel 33.

The inner rotor 31 is annular and has an outer sidewall, an end surface, a central hole 311, multiple teeth 312, and an annular protrusion 313. The end surface of the inner rotor 31 faces the second seat 20. The central hole 311 is formed through the inner rotor 31 and aligns with the first axial hole 11 of the first seat 10 and the second axial hole 21 of the second seat 20. Preferably, the central hole 311 is non-circular in cross-section. The teeth 312 of the inner rotor 31 are separately formed on and arranged around the outer sidewall of the inner rotor 31. The annular protrusion 313 is formed on the end surface of the inner rotor 31 and around the central hole 311, and protrudes in the second axial hole 21 of the second seat 20.

The outer rotor 32 is annular, is mounted around the inner rotor 31, and has an inner sidewall and multiple teeth 321. The teeth 321 of the outer rotor 32 are separately formed on and arranged around the inner sidewall of the outer rotor 32. An inner diameter of the outer rotor 32 is larger than an outer diameter of the inner rotor 31. Some of the teeth 321 of the outer rotor 32 mesh with some of the teeth 312 of the inner rotor 31. Accordingly, a gap is formed between the other teeth 321 of the outer rotor 32 and the other teeth 312 of the inner rotor 31 that do not mesh with each other. The gap selectively corresponds in position to and communicates with the oil inlet chamber 40 and the oil outlet chamber 50.

The eccentric wheel 33 is annular, is rotatably mounted in the mounting recess 200 of the second seat 20, is securely mounted around the outer rotor 32, and has an outer sidewall, a driven toothed portion 331, and an eccentric hole 332. The driven toothed portion 331 is formed on the outer sidewall of the eccentric wheel 33 and meshes with the driving toothed portion 2411 of the plug 241. The eccentric hole 332 is formed through the eccentric wheel 33. An inner diameter of the eccentric hole 332 of the eccentric wheel 33 corresponds in size to an outer diameter of the outer rotor 32. Thus, the outer rotor 32 is fitted in the eccentric wheel 33 with an outer sidewall of the outer rotor 32 abutting an inner sidewall of the eccentric wheel 33.

Figure 5:
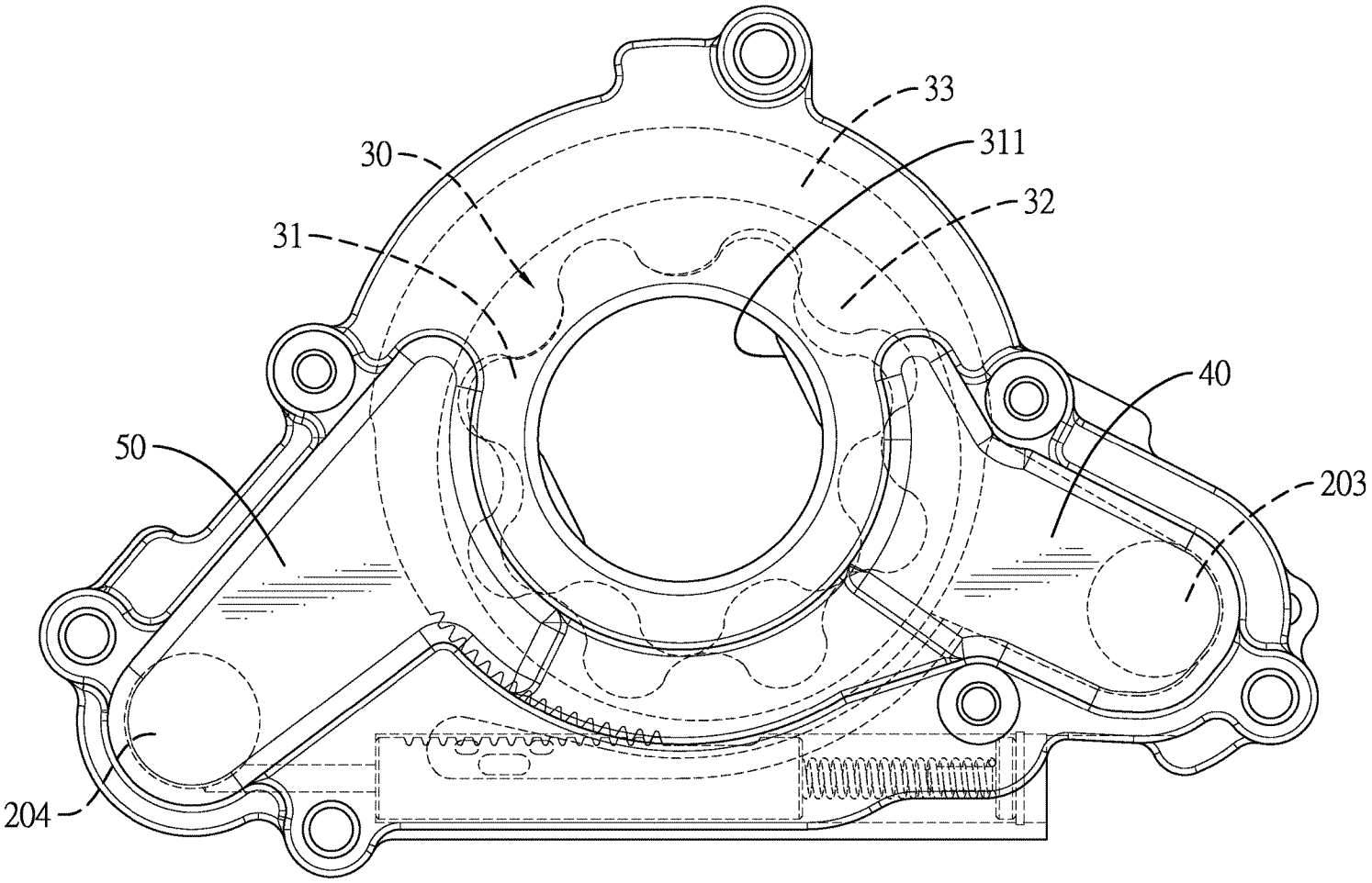
FIG. 5 is a top view of the variable flow engine oil pump in FIG. 1.

With further reference to FIG. 5, during operation, a driving shaft is mounted through the central hole 311 of the inner rotor 31, drives the inner rotor 31 to rotate, and drives the outer rotor 32 to rotate via the inner rotor 31. The inner rotor 31 and the outer rotor 32 are eccentric and mesh with each other by the teeth 312, 321. Engine oil that flows through the oil inlet 203 and into the oil inlet chamber 40 is drawn into the gap between the inner rotor 31 and the outer rotor 32. When the inner rotor 31 and the outer rotor 32 are driven to rotate, a capacity of the gap increases and decreases alternately. As the capacity of the gap decreases, the engine oil in the gap is compressed and is delivered to the oil outlet chamber 50. Then the compressed engine oil flows out through the oil outlet 204 and is provided to a cylinder of an internal combustion engine.

With further reference to FIG. 6, when needful quantity of the engine oil of the combustion is less than an output of the engine oil of the variable flow engine oil pump, oil pressure of the engine oil that is output from the engine oil pump would be raised. Then, the engine oil in the oil outlet chamber 50 flows into the guiding channel 205 to push the closed end of the plug 241, and the resilient element 242 is compressed accordingly. Thus, the plug 241 slides away from the guiding channel 205, and the engine oil further flows into the oil regulating chamber 22. Since the driving toothed portion 2411 of the plug 241 meshes with the driven toothed portion 331 of the eccentric wheel 33, as the plug 241 slides, the plug 241 drives the eccentric wheel 33 as well as the outer rotor 32 to rotate by an angle. Thus, a relative position of the outer rotor 32 and the inner rotor 31 changes, and a quantity of the engine oil that is delivered by the outer rotor 32 and the inner rotor 31 is reduced. Accordingly, the oil pressure of the engine oil that is output from the engine oil pump can be reduced. Moreover, the oil pressure of the engine oil that is output from the engine oil pump can also be reduced with the engine oil flowing from the oil outlet chamber 50 to the oil regulating chamber 22.

As shown in FIG. 6, as the oil pressure of the engine oil in the oil outlet chamber 50 is raised continuously, the plug 214 in the oil regulating chamber 22 is pushed farther away from the guiding channel 205, and the oil return hole 23 is opened. Thus, the engine oil that flows in the oil regulating chamber 22 further flows through the oil return hole 23, the oil return channel 12 and flows back to the oil inlet chamber 40. The oil pressure of the engine oil that is output from the engine oil pump is further reduced accordingly.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A variable flow engine oil pump comprising:

a first seat having a first axial hole formed through the first seat; and an oil return channel formed in an inner surface of the first seat;

a second seat attached to the first seat and having a second axial hole formed through the second seat and aligning with the first axial hole;

an oil inlet formed through the second seat;

an oil outlet formed through the second seat;

an oil regulating chamber formed in the second seat, being elongated, and having an inner end;

a guiding channel formed in the second seat and communicating with the inner end of the oil regulating chamber; and an oil return hole formed in an inner surface of the second seat, communicating with the oil regulating chamber, and corresponding in position to and communicating with the oil return channel;

an oil inlet chamber formed in the first seat and the second seat and communicating with the oil return channel;

an oil outlet chamber formed in the first seat and the second seat and communicating with the guiding channel;

a regulating valve assembly mounted in the oil regulating chamber, and including a plug slidably mounted in the oil regulating chamber and having an open end;

a closed end facing and selectively sealing the guiding channel;

a receiving recess formed in the open end of the plug; and a driving toothed portion formed on an outer surface of the plug and disposed adjacent to the closed end of the plug; and a resilient element protruding in the receiving recess of the plug and having two opposite ends, one of the ends of the resilient element mounted in the receiving recess of the plug and abutting the plug, the other end of the resilient element abutting the second seat; and a pressurizing assembly mounted in the second seat and including an inner rotor;

an outer rotor mounted around the inner rotor; and an eccentric wheel securely mounted around the outer rotor and having a driven toothed portion formed on an outer sidewall of the eccentric wheel and meshing with the driving toothed portion of the plug; and an eccentric hole formed through the eccentric wheel, such that the outer rotor is fitted in the eccentric wheel with an outer sidewall of the outer rotor abutting an inner sidewall of the eccentric wheel.

2. The variable flow engine oil pump as claimed in claim 1, wherein the first seat further has a first recess and a second recess, the first recess and the second recess are formed in the inner surface of the first seat and are respectively disposed adjacent to two opposite ends of the first seat;

the oil return channel communicates with the first recess;

the second seat further has two opposite ends;

a third recess formed in the inner surface of the second seat and disposed adjacent to one of the ends of the second seat, the third recess corresponding in position to and communicating with the first recess, and the third recess and the first recess forming the oil inlet chamber; and a fourth recess formed in the inner surface of the second seat and disposed adjacent to the other end of the second seat, the fourth recess corresponding in position to and communicating with the second recess, and the fourth recess and the second recess forming the oil outlet chamber;

the oil inlet is formed through an inner bottom defined in the third recess;

the oil outlet is formed through an inner bottom defined in the fourth recess; and the guiding channel communicates between the fourth recess and the oil regulating chamber.

3. The variable flow engine oil pump as claimed in claim 2, wherein the oil regulating chamber further has an outer end communicating with an exterior of the second seat;

the second seat further has a positioning groove formed in an interior surface defined around the oil regulating chamber and disposed adjacent to the outer end of the oil regulating chamber;

the regulating valve assembly further has an end cap mounted in the oil regulating chamber and disposed adjacent to the outer end of the oil regulating chamber, the end cap having an outer end surface;

an inner end surface; and a mounting protrusion formed on and protruding from the inner end surface of the end cap; and a retaining ring engaging in the positioning groove and abutting the outer end surface of the end cap; and one of the ends of the resilient element is mounted around the mounting protrusion of the end cap and abuts the inner end surface of the end cap while the other end of the resilient element abuts the plug.

4. The variable flow engine oil pump as claimed in claim 1, wherein the second seat further has a mounting recess formed in the inner surface of the second seat;

the pressurizing assembly is mounted in the mounting recess;

the inner rotor has a central hole formed through the inner rotor and aligning with the first axial hole and the second axial hole;

multiple teeth separately formed on and arranged around an outer sidewall of the inner rotor; and an annular protrusion formed on an end surface of the inner rotor and around the central hole, and protruding in the second axial hole;

the outer rotor has multiple teeth separately formed on and arranged around an inner sidewall of the outer rotor, an inner diameter of the outer rotor is larger than an outer diameter of the inner rotor; and the eccentric wheel is rotatably mounted in the mounting recess, an inner diameter of the eccentric hole of the eccentric wheel corresponds in size to an outer diameter of the outer rotor;

wherein some of the teeth of the outer rotor mesh with some of the teeth of the inner rotor;

a gap is formed between the other teeth of the outer rotor and the other teeth of the inner rotor that do not mesh with each other, the gap selectively corresponds in position to and communicates with the oil inlet chamber and the oil outlet chamber.

5. The variable flow engine oil pump as claimed in claim 2, wherein the second seat further has a mounting recess formed in the inner surface of the second seat;

the pressurizing assembly is mounted in the mounting recess;

the inner rotor has a central hole formed through the inner rotor and aligning with the first axial hole and the second axial hole;

multiple teeth separately formed on and arranged around an outer sidewall of the inner rotor; and an annular protrusion formed on an end surface of the inner rotor and around the central hole, and protruding in the second axial hole;

the outer rotor has multiple teeth separately formed on and arranged around an inner sidewall of the outer rotor, an inner diameter of the outer rotor is larger than an outer diameter of the inner rotor; and the eccentric wheel is rotatably mounted in the mounting recess, an inner diameter of the eccentric hole of the eccentric wheel corresponds in size to an outer diameter of the outer rotor;

wherein some of the teeth of the outer rotor mesh with some of the teeth of the inner rotor;

a gap is formed between the other teeth of the outer rotor and the other teeth of the inner rotor that do not mesh with each other, the gap selectively corresponds in position to and communicates with the oil inlet chamber and the oil outlet chamber.

6. The variable flow engine oil pump as claimed in claim 3, wherein the second seat further has a mounting recess formed in the inner surface of the second seat;

the pressurizing assembly is mounted in the mounting recess;

the inner rotor has a central hole formed through the inner rotor and aligning with the first axial hole and the second axial hole;

multiple teeth separately formed on and arranged around an outer sidewall of the inner rotor; and an annular protrusion formed on an end surface of the inner rotor and around the central hole, and protruding in the second axial hole;

the outer rotor has multiple teeth separately formed on and arranged around an inner sidewall of the outer rotor, an inner diameter of the outer rotor is larger than an outer diameter of the inner rotor; and the eccentric wheel is rotatably mounted in the mounting recess, an inner diameter of the eccentric hole of the eccentric wheel corresponds in size to an outer diameter of the outer rotor;

wherein some of the teeth of the outer rotor mesh with some of the teeth of the inner rotor;

a gap is formed between the other teeth of the outer rotor and the other teeth of the inner rotor that do not mesh with each other, the gap selectively corresponds in position to and communicates with the oil inlet chamber and the oil outlet chamber.

7. The variable flow engine oil pump as claimed in claim 4, wherein the first seat further has multiple first fastening holes separately formed through the first seat and arranged along an outer sidewall of the first seat;

the second seat further has multiple second fastening holes separately formed through the second seat, arranged along an outer sidewall of the second seat, and respectively aligning with the first fastening holes; and multiple fasteners are mounted through the first fastening holes and the second fastening holes, such that the first seat and the second seat are securely held together.

8. The variable flow engine oil pump as claimed in claim 5, wherein the first seat further has multiple first fastening holes separately formed through the first seat and arranged along an outer sidewall of the first seat;

the second seat further has multiple second fastening holes separately formed through the second seat, arranged along an outer sidewall of the second seat, and respectively aligning with the first fastening holes; and multiple fasteners are mounted through the first fastening holes and the second fastening holes, such that the first seat and the second seat are securely held together.

9. The variable flow engine oil pump as claimed in claim 6, wherein the first seat further has multiple first fastening holes separately formed through the first seat and arranged along an outer sidewall of the first seat;

the second seat further has multiple second fastening holes separately formed through the second seat, arranged along an outer sidewall of the second seat, and respectively aligning with the first fastening holes; and multiple fasteners are mounted through the first fastening holes and the second fastening holes, such that the first seat and the second seat are securely held together.

* * * * *